US005575098A

United States Patent [19]

Goettel-Schwartz

[11] Patent Number: 5,575,098

[45] Date of Patent: Nov. 19, 1996

[54] ILLUMINATED DISPLAY APPARATUS

[75] Inventor: Jeanette C. Goettel-Schwartz, Monmouth Junction, N.J.

[73] Assignee: Sunbeam Oster, Chicago, Ill.

[21] Appl. No.: 358,403

[22] Filed: Dec. 19, 1994

Related U.S. Application Data

[63] Continuation of Ser. No. 47,461, Apr. 19, 1993, abandoned.

[51] Int. Cl.[6] ..... G09F 13/28; F21S 1/02

[52] U.S. Cl. ..... 40/550; 362/151; 362/800; 362/806

[58] Field of Search ..... 40/550, 581, 579; 362/151, 252, 124, 122, 806, 800

[56] References Cited

U.S. PATENT DOCUMENTS

| | | | |
|---|---|---|---|
| 1,779,764 | 10/1930 | Dasch . | |
| 1,850,285 | 3/1932 | Miller | 40/550 |
| 2,564,865 | 8/1951 | Turner et al. . | |
| 2,662,163 | 12/1953 | Mollner | 362/151 |
| 3,271,568 | 9/1966 | Lundberg . | |
| 3,650,059 | 3/1972 | Johnson | 40/316 |
| 3,887,803 | 6/1975 | Savage, Jr. | 240/151 |
| 4,425,605 | 1/1984 | Cheng | 362/252 X |
| 4,574,269 | 3/1986 | Miller | 40/550 |
| 4,607,444 | 8/1986 | Foster | 40/550 |
| 4,949,415 | 8/1990 | Selga | 40/124.1 X |
| 4,967,317 | 10/1990 | Plumly | 40/550 X |
| 5,128,850 | 7/1992 | Juodvalkis | 40/579 X |

*Primary Examiner*—Hoang Nguyen
*Attorney, Agent, or Firm*—Martin Sachs

[57] ABSTRACT

An illuminated display apparatus includes embossed or quilted indicia artistic and pleasing to small children applied to a generally flat surface that is provided with a plurality of apertures disposed at locations relating to the indicia placed thereon and includes illumination devices extending through the plurality of apertures. A solid state switching device applies electrical power to the illumination devices to energize them. Electrical conductors interconnect the source of electrical energy, the switching device, and the illumination devices, all of which are embedded in a soft sponge-like material sandwiched between a backing material cooperating with the flat surface, sandwiching the electrical components therebetween. The illumination devices may be affixed to a hard frame (valance) or curtain rod for display or may be left unframed where it can function as an illuminated flag, blanket, or wall hanging.

20 Claims, 3 Drawing Sheets

ILLUMINATED DISPLAY APPARATUS

The present Application is a Continuation of application Ser. No. 08/047,461, filed Apr. 19, 1993, by the Applicant Jeanette Goettel-Schwartz, now abandoned.

BACKGROUND OF THE INVENTION

1. Field of the Invention

The present invention relates to display apparatus, and in particular to illuminated artistic display apparatuses suitable for a night light, with the display being of a figure generally known and pleasing to children.

2. Discussion of the Relevant Art

The art abounds with illuminated sign devices such as U.S. Pat. No. 1,779,764 issued to A. Dash on Oct. 28, 1930, which discloses a fabric member provided with a plurality of letters or numbers that are transparent or translucent with a lighting source (light bulb) disposed behind the indicia, which becomes clearly visible at night and is disposed on the flap portion of an awning.

In U.S. Pat. No. 2,564,865 issued to H. B. Turner, et al. on Aug. 21, 1951, a window canopy or valance is disclosed, which is illuminated providing indirect lighting in the room that it is mounted in.

In U.S. Pat. 3,271,568 issued to Lundberg on Sep. 6, 1966, discloses a mural, which is placed over a window and has a structure disposed thereabove providing light that illuminates a scene (mural) provided on a generally flat surface.

However, none of the known prior art devices are suitable as a night light for children who are afraid of the dark or provides a relaxing figure, which is known to the child. The instant invention overcomes the shortcomings found in the prior art and provides artistic indicia thereon in the form of an object or character known to children and has illumination disposed as pinpoints (small bulbs) disposed at selected points throughout the indicia providing a warm glow suitable as a night light and which may be switched on and off at various prescribed times or sequences.

SUMMARY OF THE INVENTION

An illuminated display apparatus, according to the principle of the present invention comprises in combination, artistic quilted indicia applied to a generally flat flexible surface, provided with a plurality of apertures disposed at particular locations related to the indicia placed thereon. A plurality of miniature light bulbs or light pipes extend through the aperture and are illuminated by means of a switching device which applies electrical energy to power the light bulbs or light pipe. Electrical conducting wires or conductive tape interconnect the lighting device and the switching apparatus, which are adapted to be connected to a source of electrical energy and are embedded in a soft sponge-like material, e.g. fiber fill. A backing and the central fiber fill, which allows for quilting, cooperates with the generally flat surface, sandwiching the rear portion of the illumination device and the switching apparatus and the electrical conductors therebetween.

It is an object of the invention to provide an illuminate display suitable as a night light.

It is a further object of the invention to provide an illuminated display suitable for use as a flag.

It is still a further object of the invention to provide an illuminated display suitable to be unmounted, mounted in a frame or on a valance, or on a curtain rod.

It is still a further object of the invention to provide an illuminated wall hanging suitable as a display in a child's bedroom.

It is yet still another object of the invention to provide an illuminated valance that utilizes an external power source.

BRIEF DESCRIPTION OF THE DRAWING

In order that the invention may be more fully understood, it will now be described, by way of example, with reference to the accompanying drawings in which.

DESCRIPTION OF THE PREFERRED EMBODIMENT

Figure 1:
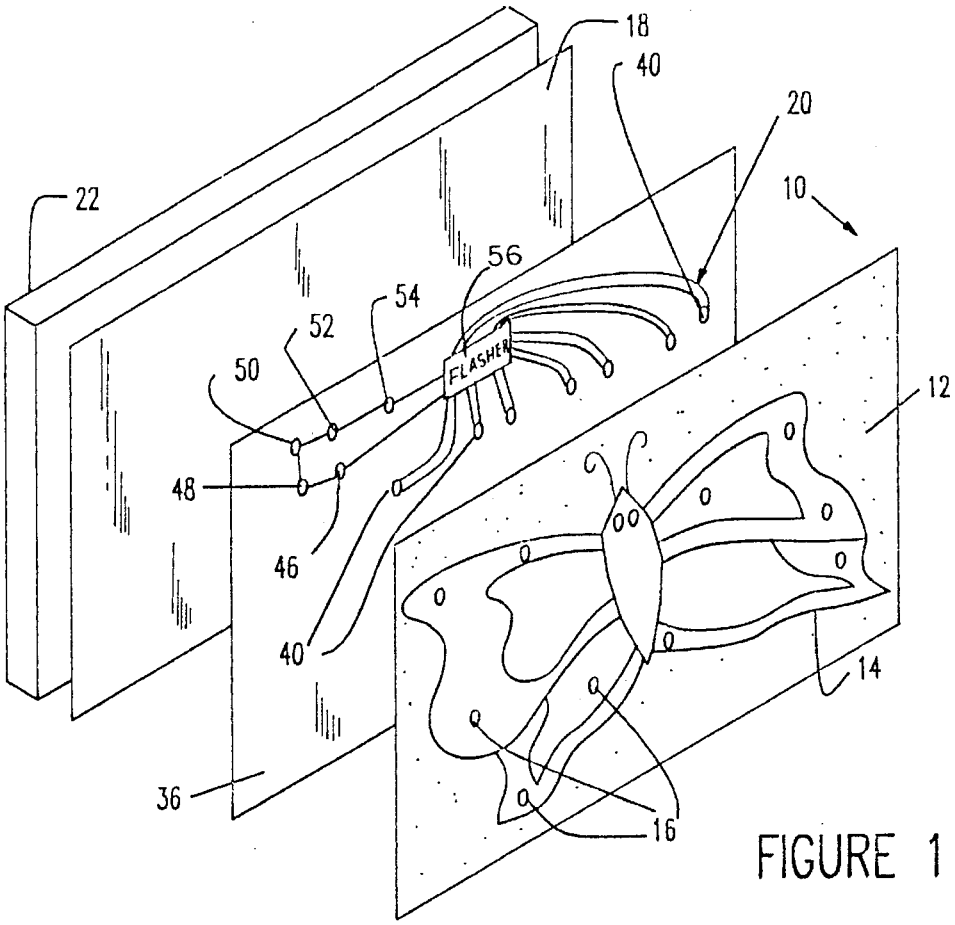
FIG. 1 is an exploded view in perspective of the illuminated display apparatus disposed in a frame, according to the principles of the present invention.
Figure 2:
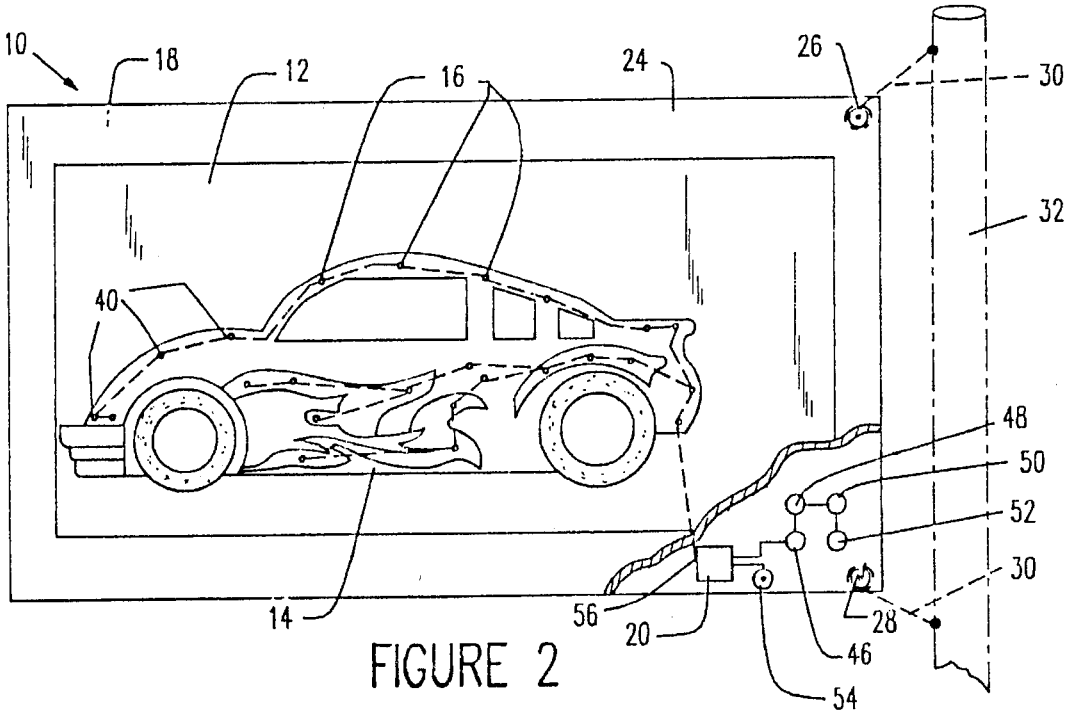
FIG. 2 is a front view of the apparatus, having differ indicia thereon in a flexible arrangement suitable of being utilized as a flag.

Referring now to the figures, and in particular to FIGS. 1 and 2, there is shown an illuminated display apparatus 10, according to the principles of the present invention, which includes a generally flat surface material 12. The indicia 14 in FIG. 1 is an artistic version of a butterfly, which may be painted on the flat surface 12, embossed or padded to have the indicia 14 stand out from the flat surface material 12. A plurality of apertures 16 are disposed about the indicia as determined by the artist that created same.

Figure 5:
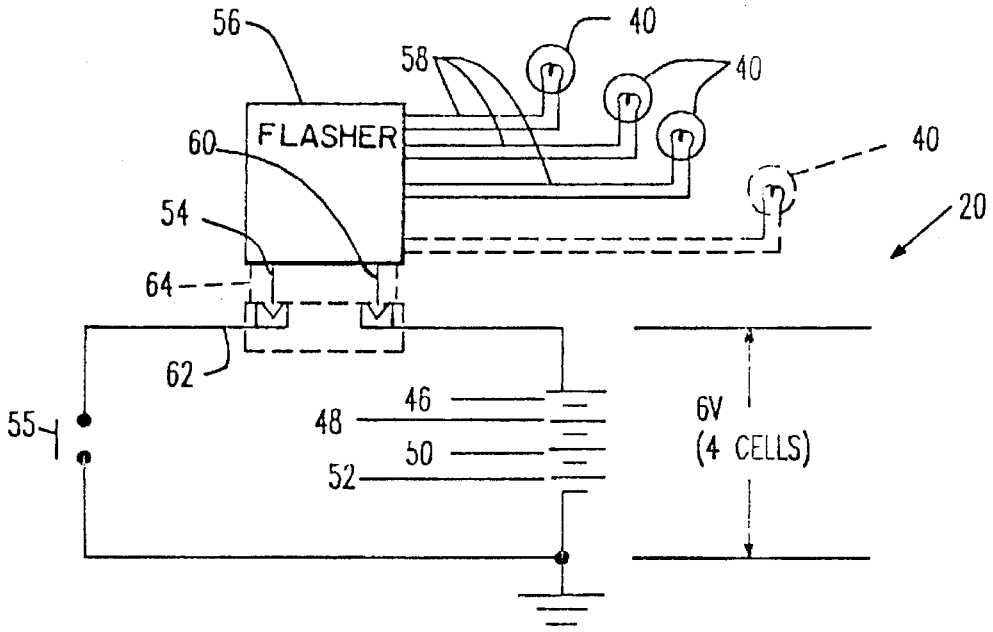
FIG. 5 is an electrical circuit diagram of the battery operated display apparatus.

The electrical circuitry 20 is described in detail in conjunction with FIG. 5, and is disposed beneath the flat surface material 12 and disposed within the quilting or sponge-like material 36.

A backing member 18, which is fabricated from a flexible material, sandwiches the electrical circuitry 20 together with the flat surface material 12. Preferably the backing member 18 may be made of a soft material such as cloth, etc. or alternatively it may be made of a rigid material. If a soft material is used then the assembly of the backing material, electronic circuitry and the flat surface material forming a sandwich may be placed into a frame 22. The frame 22 may be similar to a conventional picture frame suitable for display on a flat horizontal surface or alternatively may have a wire affixed to the back thereof suitable for hanging on a vertical surface. If the backing member 18 is fabricated from a rigid material, such as any of the modern day plastics, it may function as a picture frame when sealed, in a conventional manner, to the generally flat surface material 12 with the electrical circuitry 20 disposed therebetween.

The embodiment disclosed in FIG. 2 utilizes a backing material 18, which is fabricated from a relatively soft material. By using a reinforcing material 24 to form a secure border around the sandwich of the flat surface 12 and the backing member 18, strength is added to the material. The border 24 is affixed thereon in a conventional manner, such as by sewing or using an adhesive material. The border member 24 may include a pair of eyelets 26 and 28, suitable for receiving a mounting means such as rope 30, which may be connected to a rod or stick 32 so that the illuminated display apparatus 10 may be utilized as a flag that can wave in the wind. Alternatively, the electronic circuitry 20 may be constructed relatively flat, and by not taking up much room permits the illuminated display apparatus to be utilized as a place mat, wherein the eyelets 26 and 28 would not be needed.

Figure 3:
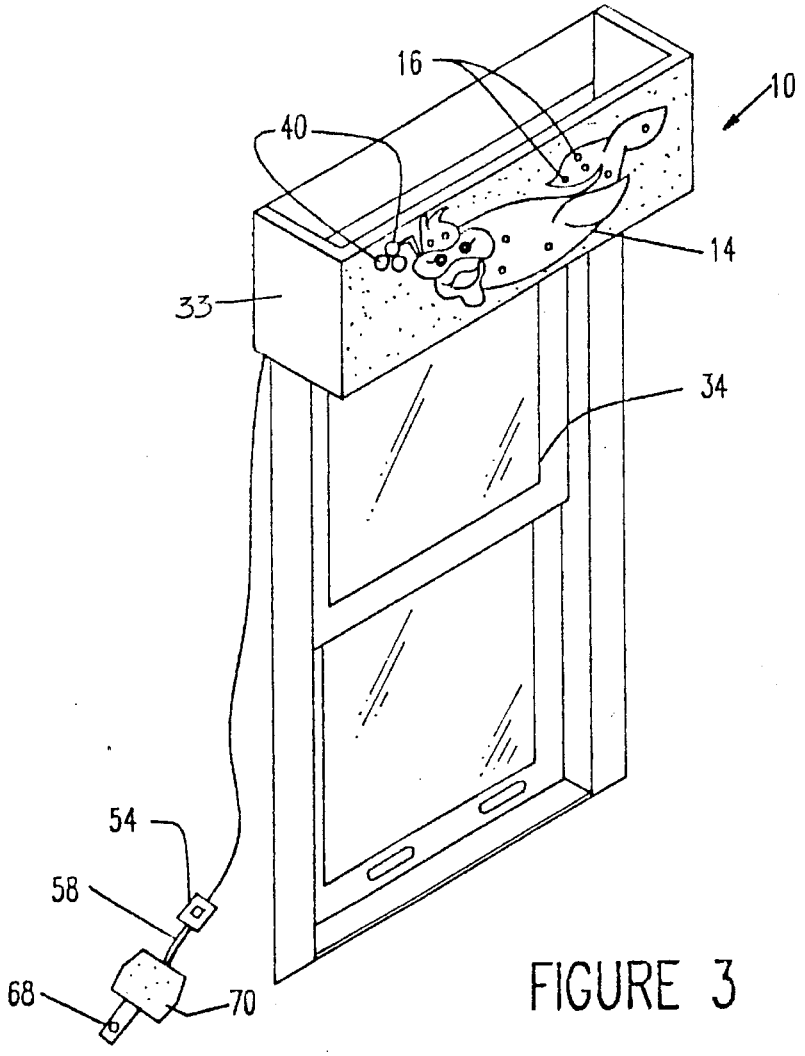
FIG. 3 is a partial cross section of the apparatus shown in FIGS. 1 and 2 depicting the mounting of a miniature light bulb in the generally flat surface, which has indicia placed thereon.

In the alternative embodiment, shown in FIG. 3, the illuminated display apparatus 10 is fixed to a rigid member 33, such as a valance or cornice mounted above, in a conventional manner, a window 34 that generally appears in a child's bedroom, thus being suitable for use as a night light or means for entertaining a child.

Figure 4:
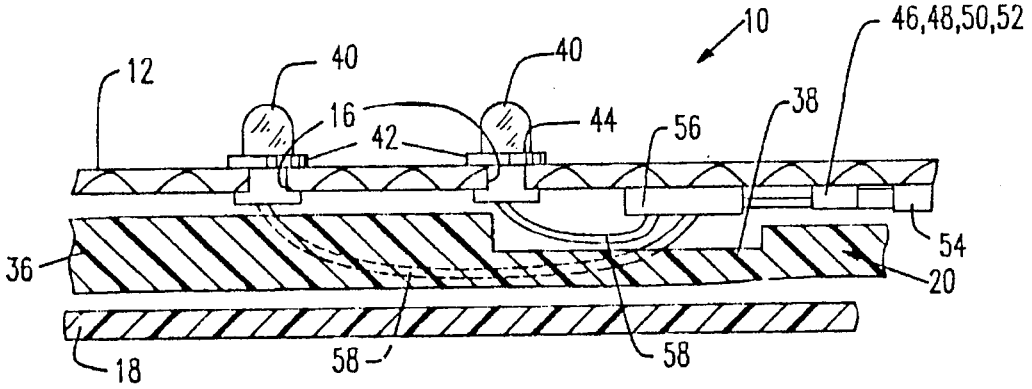
FIG. 4 is an alternative embodiment of the apparatus disclosed in FIG. 1, wherein the illuminated display is placed on a valance over a window and includes an external power source.

Referring now to FIG. 4, which is a cross-section of the generally flat surface material 12 and backing member 18 with the electrical circuitry 20 disposed therebetween. The sponge-like material or quilting 36 may be used between the flat surface material 12 and the backing member 18 into which cut-outs 38 have been made so that the electronic components 20 may be inserted therein, thereby providing a smooth mating surface if desired. The illuminating device 40 may be a miniature light bulb suitable for operation at a low voltage, preferably 6 volts D.C., or any other light activated device (LED) suitable for meeting the requirement of the circuit, which arrangement requires a long life and operation at a low voltage. The illumination device 40 is held within the apertures 16 provided in the flat surface material 12 by an O-ring 42, which has an aperture 44 to firmly receive the illumination device 40 therein and hold it to the flat surface material 12.

Referring now to FIG. 5, which is the electrical circuit diagram (schematic) for the 6 volt D.C. arrangement utilized for powering the light bulbs. The battery consists of four separate 1½ volt cells 46, 48, 50 and 52 connected in series to provide the six volts which then is serially connected to a miniature flat push button, on/off switch 55. The switch 55 is connected to the power terminal 54 of a unitary integrated switching circuitry module 56 which couples the power to illuminate the light bulbs 40 (illuminating device). The illuminating device 40 may be any number of device types to which the batteries 46, 48, 50 and 52 are capable of supplying long lasting energy thereto for illumination purposes. All of the electrical connections are made by conducting members 58, which may be conventional wires or printed circuit ribbon conductors. The other terminal 60 of the module 56 completes the series circuit path to the batteries 46, 48, 50 and 52. The electrical circuit components 54, 56, 58 and the batteries 46, 48, 50 and 52 may all be sandwiched in a relatively thin printed circuit arrangement, not shown, and may be directly wired to the switching module 56 and the illumination devices 40.

Alternatively, the circuit arrangement less the switch 54 and batteries 46, 48, 50 and 52 may be provided in a separate assembly with a female connector 62 disposed thereon, which mates with a male connector 64 sandwiched between the flat surface material 12 and the backing member 18 disposed proximate the edge thereof, so that the connector may be readily separated and the power source replaced with another fully charged one if desired.

In an alternative circuit arrangement, typically used for the arrangement of FIG. 3, a plug 66 suitable for insertion into a conventional 120 volt A.C. socket may also include a switch 54, a power transformer 70 and a diode bridge assembly 72 to provide 6 volts D.C., which is connected to female connector 62 having two terminals 74 and 76 thereon adapted to mate with terminals 64 and 60. Thus, one would have the option of readily exchanging one power source for another or alternatively changing from a battery operated supply to one that would be energized from the 120 volt A.C. wall socket 68.

Figure 6:
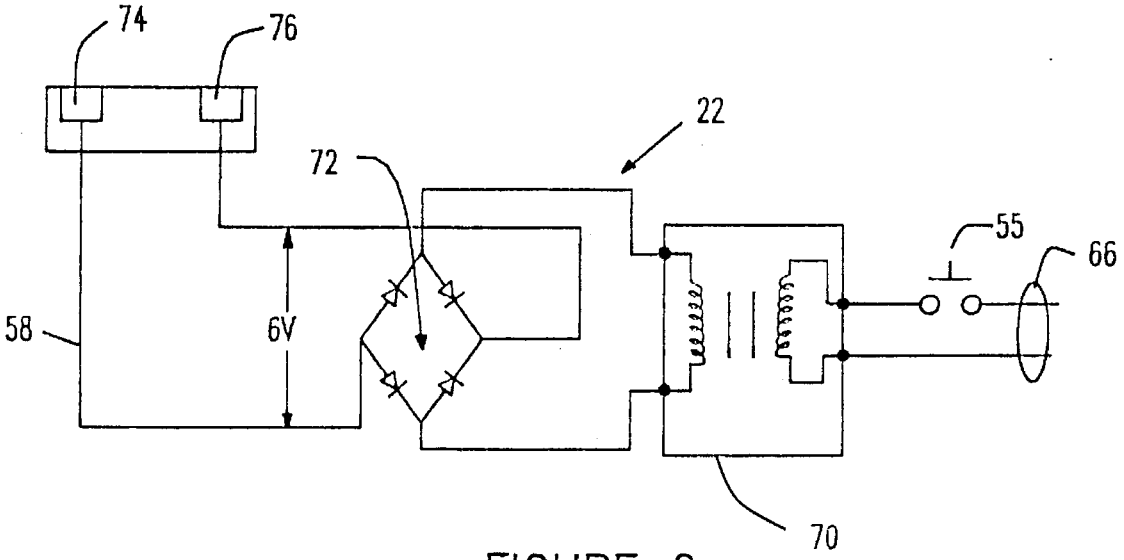
FIG. 6 is an electrical circuit diagram of an external power source suitable for plugging into a standard 120 volt A.C. outlet The subject matter which I regard as my invention is particularly pointed out and distinctly claimed in the concluding portion of the specification. My invention, itself, however both as to its organization and method of operation, together with further objects and advantages thereof may best be understood by reference to the following description taken in connection with the accompanying drawing wherein like reference characters refer to like components.

In operation, the embodiment disclosed in FIGS. 1 or 2 may be illuminated by merely pressing the on/off button switch 54 and the illumination would occur of all the illumination devices 40. The switching means may be of the type that illuminates all the bulbs at the same time or alternatively can switch them on in any sequence desired by choosing the proper switching device 56. If the batteries should go dead (loose their voltage) they may reading be replaced by utilizing the embodiment disclosed in FIG. 5 or 6.

Hereinbefore has been disclosed an illuminated apparatus suitable for a night light or display. It will be understood that various changes in the details, materials, arrangement of parts and operating conditions which have been herein described and illustrated in order to explain the nature of the invention may be made by those skilled in the art within the principles and scope of the instant invention.

Having thus set forth the nature of the invention, what is claimed is:

1. An illuminated display apparatus, comprising in combination:

a) indicia being artistic and pleasing to small children applied to a generally flat flexible surface, said flat surface being provided with a plurality of apertures disposed at particular locations related to said indicia;

b) a plurality of illumination means having a front portion and a rear portion, each of said illumination means having said front portion thereof disposed in each of said apertures;

c) switching means for applying electrical power to said rear portions of said illumination means to energize them;

d) electrical conducting means interconnecting the rear portion of said illumination means and said switching means adapted to be connected to a source of electrical energy;

e) soft sponge-like material, said sponge-like material being adapted to receive said switching means and said electrical conducting means therein; and f) backing means cooperating with said generally flat surface for sandwiching said rear portions of said illumination means, said switching means, said conducting means, and said sponge-like material therebetween.

2. An illuminated display apparatus according to claim 1, wherein said sponge-like material is affixed to said flat flexible surface by a quilting process.

3. An illuminated display apparatus according to claim 1, further including mounting means for supporting said illuminated display apparatus suitable for maintaining said apparatus in a nonmovable fixed position.

4. An illuminated display apparatus according to claim 1, further including mounting means for supporting said illuminated display apparatus suitable for maintaining said apparatus in a non-fixed or flutterable position.

5. An illuminated display apparatus according to claims 1 or 4, further including a power switch means disposed between said source of electrical energy and said switching means for applying electrical energy to power to said display.

6. An illuminated display apparatus according to claims 1 or 4, further including support means for holding said illumination means to said generally flat surface.

7. An illuminated display apparatus according to claims 1 or 4, wherein said switching means is fabricated in a unitary integrated circuit module.

8. An illuminated display apparatus according to claim 1, wherein a power switching means is sandwiched between said generally flat flexible surface and said backing means.

9. An illuminated display apparatus according to claims 1 or 3, further including:

a. connector means disposed in said sponge-like material and sandwiched between said generally flat surface and said backing means;

b. remotely disposed power pack means adapted to be connected to a source of electrical energy, said power pack means having;

i) power switch means for completing the conducting path to a source of electrical energy, and ii) mating connector means adapted to be removably connected to and cooperate with said connector means.

10. An illuminated display apparatus according to claims 1 or 3, further including retaining means disposed in said sponge-like material between said flat surface and said backing means for holding a power switch means, said switching means, said electrical conducting means and the rear portion of said illumination means therein providing a second generally flat surface upon which said backing means is affixed.

11. An illuminated display apparatus according to claim 1 wherein said backing means is fabricated from a rigid material.

12. An illuminated display apparatus according to claim 1 wherein said illuminated display functions as a place mat.

13. An illuminated display apparatus, comprising in combination:

a) quilted indicia being artistic and pleasing to small children applied to a generally flat flexible surface, said flat surface being provided with a plurality of apertures disposed at particular locations related to said quilted indicia;

b) a plurality of illumination means having a front portion and a rear portion, each of said illumination means having said front portion thereof disposed in each of said apertures;

c) switching means for applying electrical power to said rear portions of said illumination means to energize them;

d) electrical conducting means interconnecting the rear portion of said illumination means and said switching means adapted to be connected to a source of electrical energy;

e) soft sponge-like material, said sponge-like material being adapted to receive said switching means and said electrical conducting means therein; and f) backing means cooperating with said generally flat surface for sandwiching said rear portions of said illumination means, said switching means, said conducting means, and said sponge-like material therebetween.

14. An illuminated display apparatus according to claim 13, further including mounting means for supporting said illuminated display apparatus suitable for maintaining said apparatus in a nonmovable fixed position.

15. An illuminated display apparatus according to claim 13, further including mounting means for supporting said illuminated display apparatus suitable for maintaining said apparatus in a non-fixed or flutterable position.

16. An illuminated display apparatus according to claims 13, further including a power switch means disposed between said source of electrical energy and said switching means for applying electrical energy to power to said display.

17. An illuminated display apparatus according to claims 13, wherein said switching means is fabricated in a unitary integrated circuit module.

18. An illuminated display apparatus according to claim 13, wherein a power switching means is sandwiched between said generally flat flexible surface and said backing means.

19. An illuminated display apparatus according to claims 13, further including retaining means disposed in said sponge-like material between said flat surface and said backing means for holding a power switch means, said switching means, said electrical conducting means and the rear portion of said illumination means therein providing a second generally flat surface upon which said backing means is affixed.

20. An illuminated display apparatus according to claims 13, further including:

a. connector means disposed in said sponge-like material and sandwiched between said generally flat surface and said backing means;

b. remotely disposed power pack means adapted to be connected to a source of electrical energy, said power pack means having;

i) power switch means for completing the conducting path to a source of electrical energy, and ii) mating connector means adapted to be removably connected to and cooperate with said connector means.

* * * * *